US005697583A

United States Patent [19]

Kane

[11] Patent Number: 5,697,583

[45] Date of Patent: Dec. 16, 1997

[54] RADIO FREQUENCY COUPLER FOR COMMUNICATION BETWEEN ADJACENT RAILWAY CARS

[75] Inventor: Michael Kane, Ridge, N.Y.

[73] Assignee: Dorne & Margolin, Inc., Bohemia, N.Y.

[21] Appl. No.: 713,521

[22] Filed: Sep. 13, 1996

[51] Int. Cl.[6] ..... B61L 23/00

[52] U.S. Cl. ..... 246/187 C; 246/167 R; 213/1.3; 340/870.11

[58] Field of Search ..... 246/166.1, 167 R, 246/169 R, 187 C; 213/1.3; 340/870.1, 870.15; 364/424.01, 424.03, 424.05

[56] References Cited

U.S. PATENT DOCUMENTS

| | | | |
|---|---|---|---|
| 3,696,758 | 10/1972 | Godinez, Jr. . | |
| 4,582,280 | 4/1986 | Nichols et al. . | |
| 4,723,737 | 2/1988 | Mimoun . | |
| 5,182,570 | 1/1993 | Nysen et al. | 343/795 |
| 5,351,919 | 10/1994 | Martin . | |
| 5,435,505 | 7/1995 | Martin . | |

*Primary Examiner*—S. Joseph Morano
*Attorney, Agent, or Firm*—Anthony R. Barkume, P.C.

[57] ABSTRACT

A radio frequency coupling device used in conjunction with a communications system for effecting free space communications between adjacent cars on a multi-car vehicle, wherein each of the cars has coupling arms for connecting the cars to each other, and wherein each of the cars further comprises radio frequency transceivers. The RF coupling device of the present invention is implemented by mounting the first coupler housing on a coupler arm of a first car, the first coupler housing comprising a first antenna element and a third antenna element configured so as to transceive separate channels of radio frequency energy substantially out of phase from each other. The second coupler housing is mounted on a coupler arm of a second car and comprises a second antenna element and a fourth antenna element and located near the first coupler housing when the coupler arms of the cars are mechanically joined together. The second antenna element and the fourth antenna element transceive separate channels of radio frequency energy substantially out of phase from each other. The second antenna element is located near the first antenna element and substantially in phase therewith so as to couple a first channel of radio frequency energy therebetween. The fourth antenna element is located near the third antenna element and substantially in phase therewith so as to couple a second channel of radio frequency energy therebetween.

10 Claims, 4 Drawing Sheets

RADIO FREQUENCY COUPLER FOR COMMUNICATION BETWEEN ADJACENT RAILWAY CARS

BACKGROUND OF THE INVENTION

This invention relates to a radio frequency (RF) coupler, and in particular to an RF coupler which allows RF communications through free space between adjacent cars of a multi-car vehicle.

Data communications between cars of a multi-car vehicle such as a railroad train is desired in many applications. Since cars in railway systems and the like are interchanged with relative frequency, it is desired to have a system in place which does not require mechanical interconnection. Mechanical interconnections between rail cars are undesired since the physical connectors tend to become dirty quickly and the performance deteriorates quickly with age.

Attempts have been made in the prior art to allow such data communications between railway cars by the use of RF transmission through free space. For example, U.S. Pat. No. 5,435,505 discloses a system wherein electronic communications between cars are effected by free space radio frequency couplings. Antennae are mounted in housings, which are in turn mounted in a fixed relationship to coupling arms for physically coupling the cars together whereby the housings, and therefore the antennas, are maintained in fixed relationship to each other. Such a system does not allow for any relative movement of the coupling housings with respect to each other since it requires the use of coupling arms which are fixed in relation thereto. Thus, such a system is limited insofar as it may only be used when the coupling arms of connected rail cars are maintained in strict fixed mechanical alignment, and does not allow for any relative movement of the coupling arms during operation of the system.

It is therefore an object of the present invention to provide an electrical communications system which provides RF communications between adjacent cars in a multi-car vehicle such as a railroad train, wherein the cars are not maintained in strict mechanical alignment and the coupling devices may have relative movement therebetween without suffering degradation of signal transfer.

It is a further object of the present invention to provide such a system which has multiple channels of communication, thereby allowing data transfer at the same frequency in both directions at the same time.

It is still further object of the present invention to provide such a system which has multiple channels of communication which have maximum isolation from each other in order that interference from each channel to the other is minimized.

SUMMARY OF THE INVENTION

In accordance with these and other objects, provided is a radio frequency coupling device for transferring radio frequency waves through free space. The RF coupling device comprises a first coupler housing comprising a first antenna element, and a second coupler housing comprising a second antenna element. The second coupler housing is located in near proximity to the first coupler housing such that the second antenna element is located in near proximity to the first antenna element and is substantially in phase therewith so as to couple radio frequency energy through the free space therebetween. The first coupler housing and the second coupler housing have at least one degree of freedom of movement therebetween. That is, the first and second coupler housings may move with respect to each other in any of the X, Y or Z axes without suffering deleterious effects in the transmission of the data signals.

In addition to such a single channel communications system, the present invention allows for dual channel communication between cars by providing a first coupler housing comprising a first antenna element and a third antenna element, the first antenna element and the third antenna element configured so as to transceive separate channels of radio frequency energy substantially out of phase from each other. A second coupler housing comprises a second antenna element and a fourth antenna element, the second coupler housing located in near proximity to the first coupler housing, the second antenna element and the fourth antenna element configured so as to transceive separate channels of radio frequency energy substantially out of phase from each other. The second antenna element is located in near proximity to the first antenna element and substantially in phase therewith so as to couple a first channel of radio frequency energy therebetween, and the fourth antenna element is located in near proximity to the third antenna element and substantially in phase therewith so as to couple a second channel of radio frequency energy therebetween. The first coupler housing and the second coupler housing have at least one degree of freedom of movement therebetween.

When used in conjunction with a communications system for effecting free space communications between adjacent cars on a multi-car vehicle, wherein each of the cars has coupling arms for connecting the cars to each other, and wherein each of the cars further comprises radio frequency transceiving means for transmitting and receiving radio frequency waves representative of data communicated between the cars; the RF coupling device of the present invention is implemented by mounting the first coupler housing on a coupler arm of a first car, the first coupler housing comprising a first antenna element and a third antenna element configured so as to transceive separate channels of radio frequency energy substantially out of phase from each other. The second coupler housing is mounted on a coupler arm of a second car, the second coupler housing comprising a second antenna element and a fourth antenna element and located in near proximity to the first coupler housing when the coupler arms of the cars are mechanically joined together. The second antenna element and the fourth antenna element are configured so as to transceive separate channels of radio frequency energy substantially out of phase from each other. The second antenna element is located in near proximity to the first antenna element and substantially in phase therewith so as to couple a first channel of radio frequency energy therebetween, and the fourth antenna element is located in near proximity to the third antenna element and substantially in phase therewith so as to couple a second channel of radio frequency energy therebetween. The first coupler housing and the second coupler housing have at least one degree of translational freedom therebetween.

BRIEF DESCRIPTION OF THE DRAWING

FIG. 2(*b*) is a perspective view of a second, mirror image coupler housing of the RF coupling device of FIG. 1;

FIG. 3(*b*) is a top view of the coupler housing of FIG. 2(*a*), and

DETAILED DESCRIPTION OF THE PREFERRED EMBODIMENT

Figure 1:
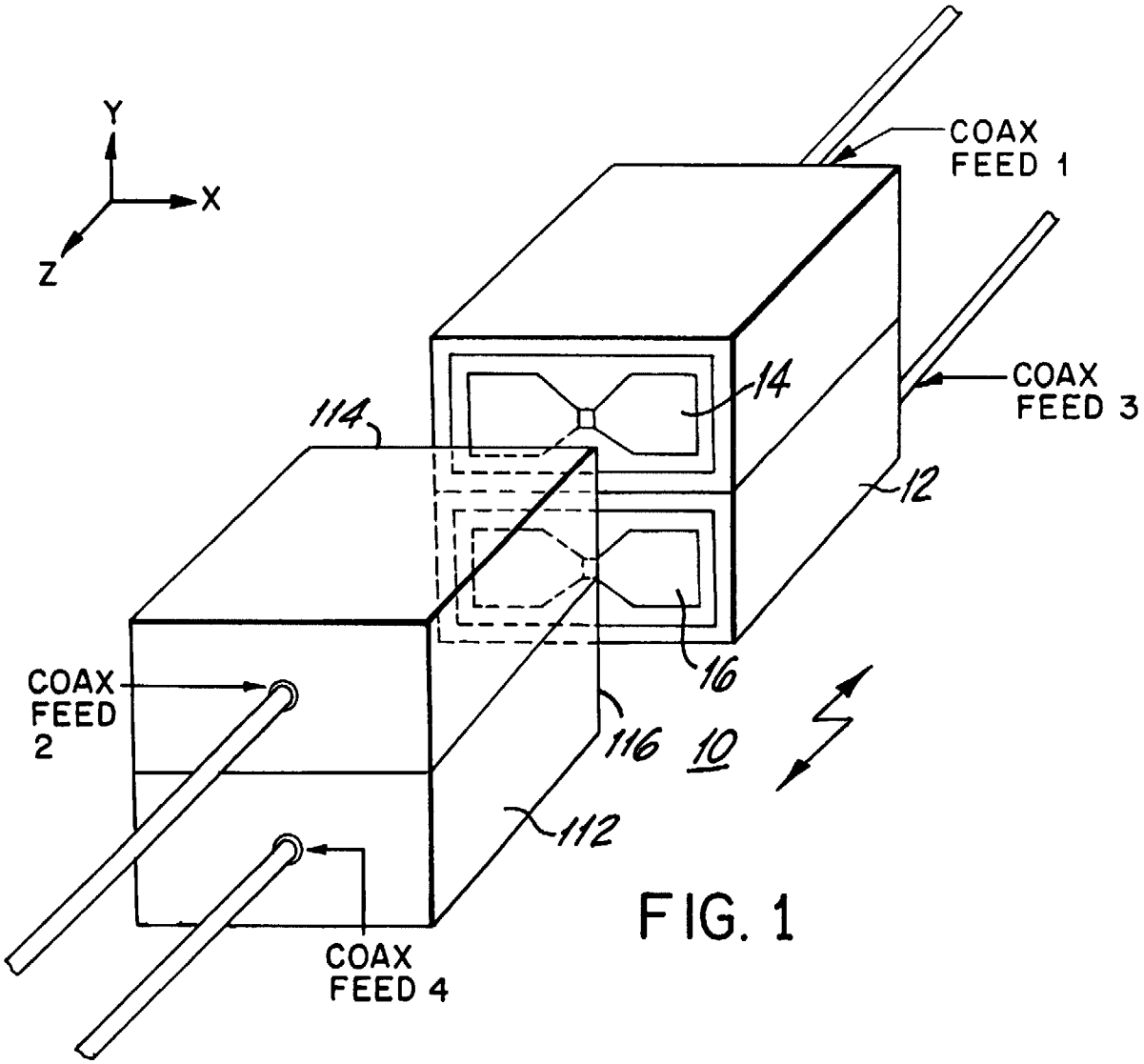
FIG. 1 is a perspective view of the RF coupler of the preferred embodiment of the present invention.

FIG. 1 illustrates a radio frequency (RF) coupling device 10 of the preferred embodiment of the present invention, comprising a first coupler housing 12 and a second coupler housing 112. The first and second coupler housings 12, 112 are the same size and configuration and have antenna elements, to be described below, which face each other and are configured so as to be mirror images of each other in order to effect efficient transfer of RF signals between the coupler housings.

Figure 2A:
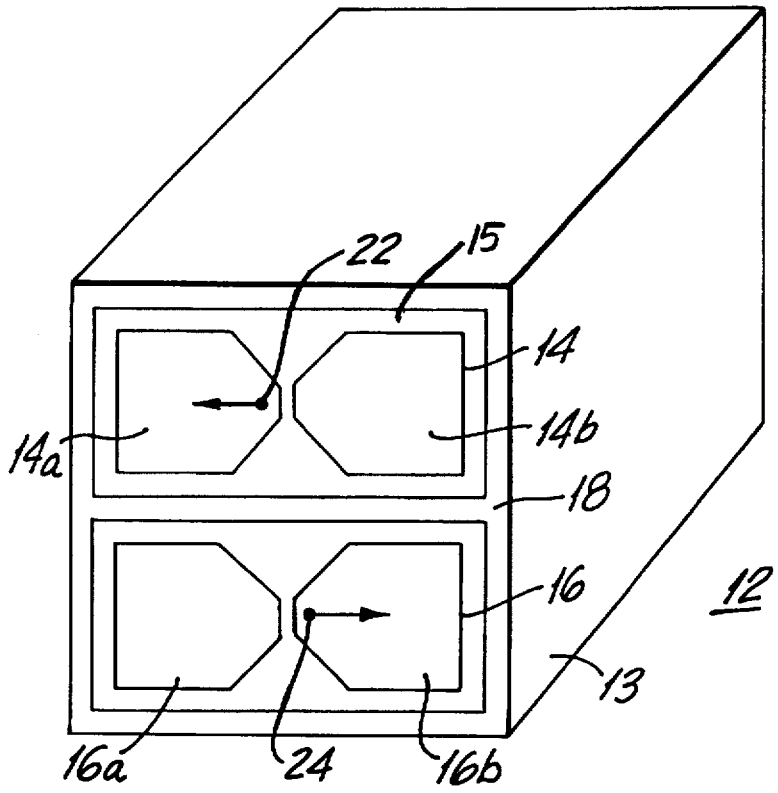
FIG. 2(*a*) is a perspective view of a first coupler housing of the RF coupling device of FIG. 1.
Figure 2B:
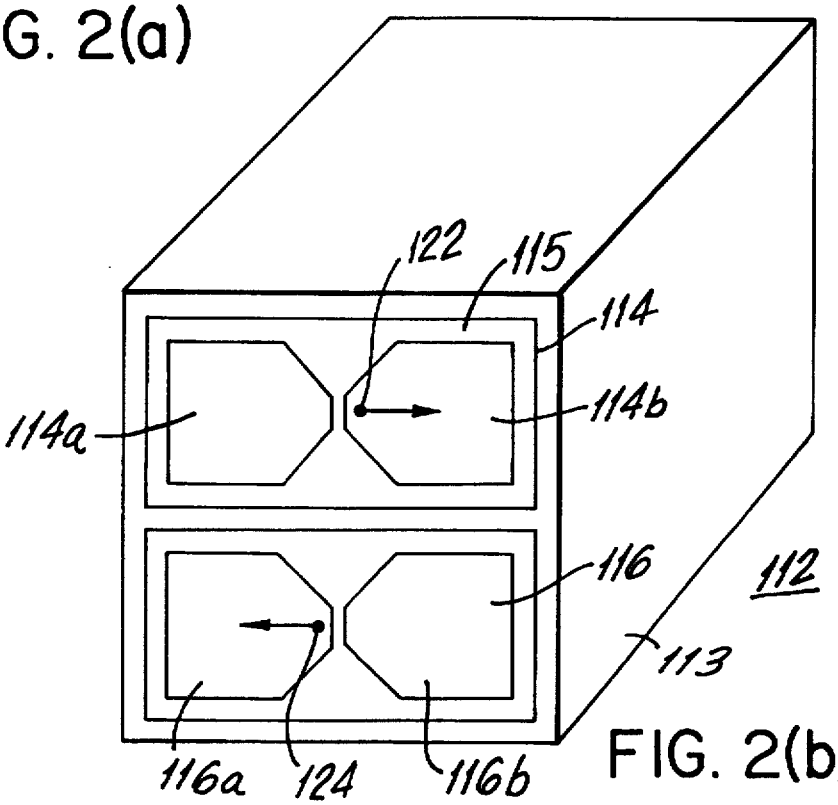

The first coupler housing 12 is shown in FIG. 2(*a*) and comprises a box-like enclosure 13 with a dielectric substrate 15 forming one face thereof. A pair of antenna elements 14 and 16, which in the preferred embodiment are dipole elements, are mounted on the substrate 15 and are designated as first antenna element 14 and third antenna element 16. The dipole antenna elements 14, 16 are formed by any means known in the art compatible with forming a flat antenna element, i.e. by copper foil, electroplating, and the like. Each dipole element 14, 16 is comprised of a pair of oppositely disposed portions 14*a*, 14*b* and 16*a*, 16*b* as shown in FIG. 2. Strips of ferromagnetic radar absorbing material 18 are disposed on the substrate 15.

Figure 3A:
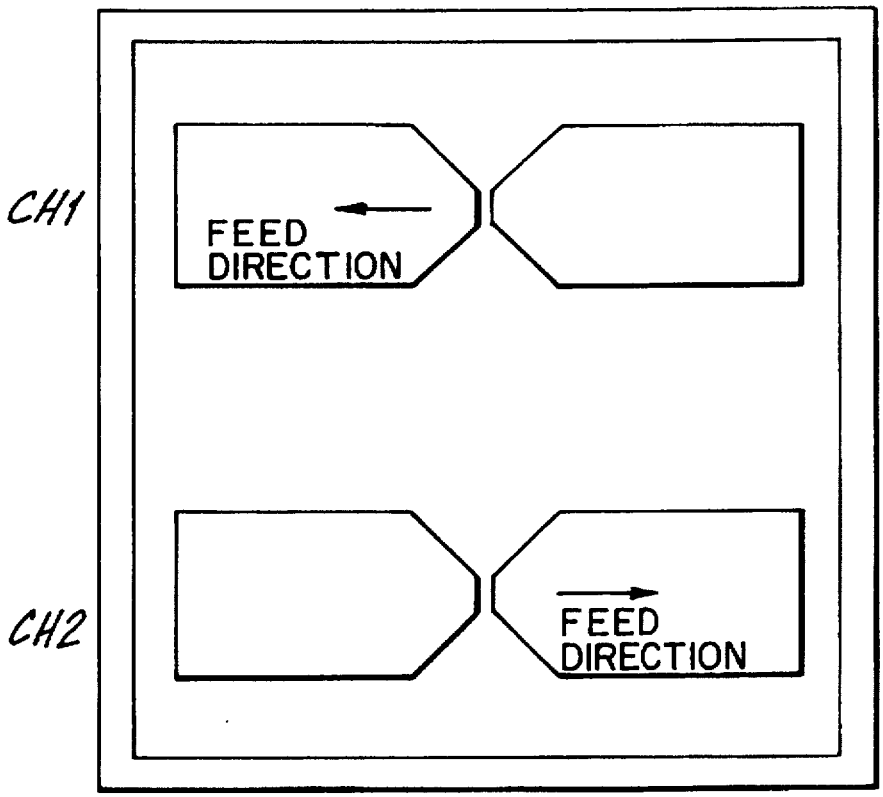
FIG. 3(*a*) is a front face view of the coupler housing of FIG. 2(*a*)
Figure 3B:
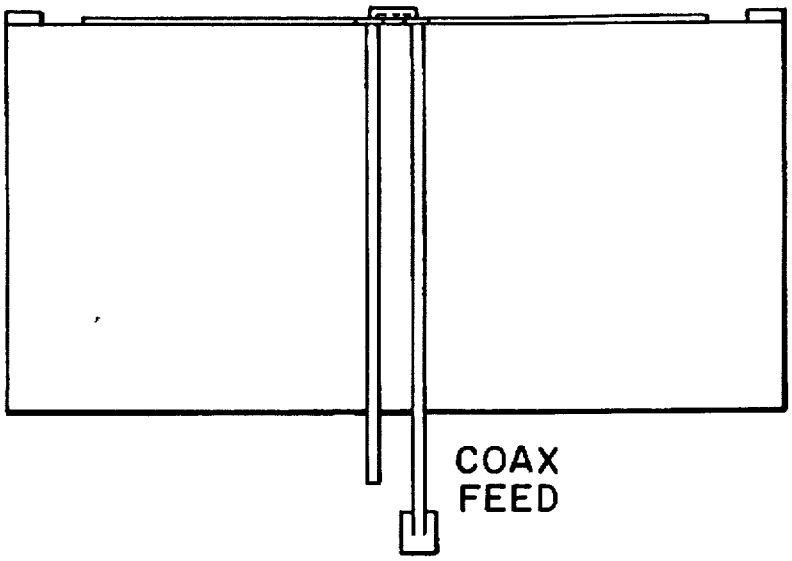
Figure 4:
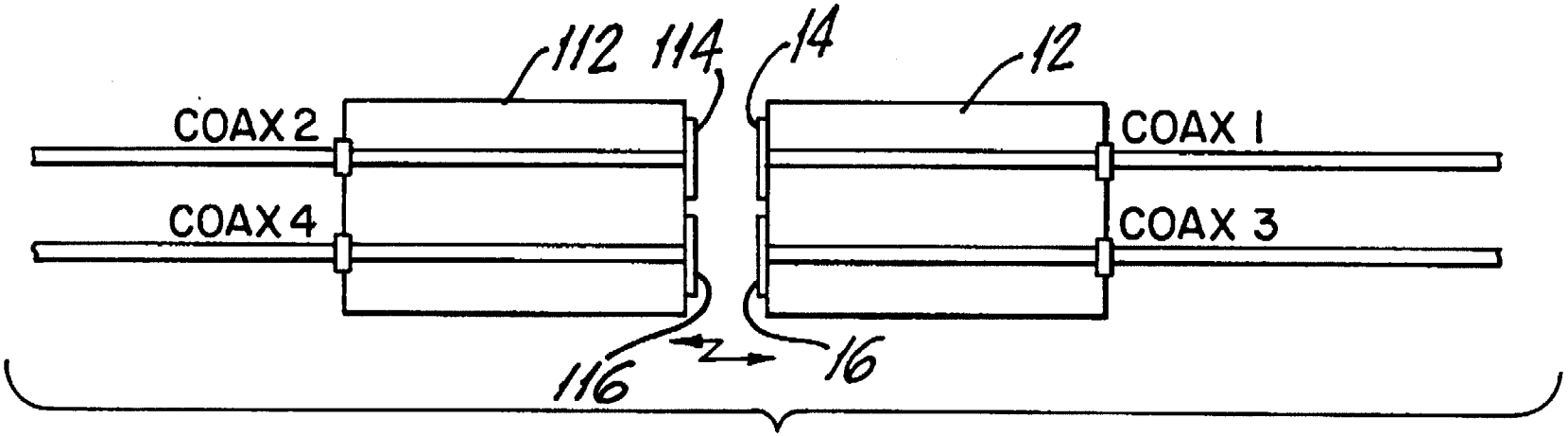
FIG. 4 is a side view of the RF coupler.

The dipole antenna elements 14, 16 are arranged so as to be substantially 180 degrees out of phase with each other by connecting each element to an associated coaxial cable transmission line (shown in FIGS. 3 and 4) in opposing fashion as shown by first feed point 22 on first antenna portion 14*a* and third feed point 24 on third antenna portion 16*b*. Correspondingly, the outer shields of the coaxial lines associated with each dipole element are connected at first antenna portion 14*b* and third antenna portion 16*a*, respectively. Thus, as illustrated herein, the propagation path for the RF signal fed to or from the first dipole element 14 via the first feed point 22 is towards the left side, while the propagation path for the RF signal fed to the third dipole element 16 via the third feed point 24 is towards the right side. The result of this configuration is that the dipole antenna elements 14 and 16 operate 180 degrees out of phase with each other. This configuration is advantageous since it allows dual channel operation at the same frequency with minimal deleterious coupling effects and thus maximum isolation between the channels.

The second coupler housing 112 is shown in FIG. 2(*b*) and is identical to the first coupler housing in FIG. 2(*a*), except that the antenna elements are mirror images of those in housing 12. That is, the feed point connections are on sides opposite to that of the first coupler housing to provide effective communications therebetween. Thus, the second coupler housing 112 comprises a box-like enclosure 113 with a dielectric substrate 115 forming one face thereof. A pair of antenna elements 114 and 116, which in the preferred embodiment are dipole elements, are mounted on the substrate 115 and are designated as second antenna element 114 and fourth antenna element 116. The dipole antenna elements 114, 116 are formed in the same manner as dipole elements 14 and 16. Each dipole element 114, 116 is comprised of a pair of oppositely disposed portions 114*a*, 114*b* and 116*a*, 116*b* as shown in FIG. 2(*b*).

The dipole antenna elements 114, 116 are arranged so as to be substantially 180 degrees out of phase with each other by connecting each element to an associated coaxial cable transmission line in opposing fashion as shown by second feed point 122 on second antenna portion 114*b* and fourth feed point 124 on fourth antenna portion 116*a*. Correspondingly, the outer shields of the coaxial lines associated with each dipole element are connected at second antenna portion 114*a* and fourth antenna portion 116*b*, respectively. Thus, as illustrated herein, the propagation path for the RF signal fed to or from the second dipole element 114 via the second feed point 122 is towards the right side, while the propagation path for the RF signal fed to the fourth dipole element 116 via the fourth feed point 124 is towards the left side. The result of this configuration is that the dipole antenna elements 114 and 116 operate 180 degrees out of phase with each other, and they are in phase with associated dipole elements 14 and 16, respectively. This configuration is advantageous since it allows dual channel operation at the same frequency with minimal deleterious coupling effects and thus maximum isolation between the channels.

In operation, the coupler housings 12 and 112 are brought in near proximity to and within the very near field of each other (i.e., approximately 0.1"), such as by attaching each to oppositely disposed coupler arms of a multi-car vehicle. An RF transmitter is connected via coax feed 1 to first antenna element 14, and an RF receiver is connected via coax feed 2 to second antenna element 114, thus forming channel A. Likewise, an RF receiver is connected via coax feed 3 to third antenna element 16, and an RF transmitter is connected via coax feed 4 to fourth antenna element 116, thus forming channel B. Signals may be transferred along channels A and B at the same frequency in opposite directions without deleterious cross-coupling effects since the antenna elements of channel A are 180° out of phase with the antenna elements of channel B, thus forming a bi-directional system. Due to the near field coupling effect between the coupler housings 12, 112, there is tolerance for some movement between the housings. It has been observed that lateral (i.e., side to side x-direction or top-to-bottom y-direction) movement on the order of approximately ½ inch may take place without having substantial signal transfer degradation. It has also been observed that the housings may be displaced away from each other (z-direction) by about ⅛ inch without having substantial signal transfer degradation.

Alternative embodiments of the above described coupling antenna may be implemented within the spirit and scope of the present invention. For example, a single channel coupling device may be implemented when only one channel of communications is required. Further, the dual channel embodiment described herein may be used to transmit data in two different directions at the same time, or they may be used to transmit data in the same direction at different frequencies, and the like. Due to the advantages attained by operating the channels substantially out of phase with each other, isolation between the channels allows such flexibility in use as heretofore unrealized in the prior art.

Additionally, the design can be substantially reduced by using materials with higher dielectric properties, which would decrease the size of the current design for a given frequency or allow the same size to be used for a lower frequency.

I claim:

1. A radio frequency coupling device for transferring radio frequency waves through free space comprising:

a) a first coupler housing comprising a first antenna element and a third antenna element, said first antenna element and said third antenna element configured so as to transceive separate channels of radio frequency energy substantially out of phase from each other; and b) a second coupler housing comprising a second antenna element and a fourth antenna element, said second coupler housing located in near proximity to said first coupler housing, said second antenna element and said fourth antenna element configured so as to transceive separate channels of radio frequency energy substantially out of phase from each other, said second antenna element located in near proximity to said first antenna element and substantially in phase therewith so as to couple a first channel of radio frequency energy therebetween, and said fourth antenna element located in near proximity to said third antenna element and substantially in phase therewith so as to couple a second channel of radio frequency energy therebetween;

said first coupler housing and said second coupler housing having at least one degree of translational freedom therebetween.

2. The radio frequency coupling device of claim 1 wherein each of said antenna elements are a dipole antenna.

3. The radio frequency coupling device of claim 2 wherein each of said coupler housings comprise a substantially flat dielectric substrate for mounting said dipole antenna elements thereon.

4. The radio frequency coupling device claim 3 wherein each of said dipole antenna elements are comprised of planar metal elements.

5. The radio frequency coupling device of claim 1 wherein said first and third antenna elements are configured to be about 180 degrees out of phase with each other and wherein said second and fourth antenna elements are configured to be about 180 degrees out of phase with each other.

6. The radio frequency coupling device of claim 5 wherein each of said antenna elements are a dipole antenna mounted on a substantially flat dielectric substrate.

7. The radio frequency coupling device of claim 6 wherein each of said antenna elements are coupled to a coaxial transmission line for transfer of electromagnetic energy therebetween.

8. The radio frequency coupling device of claim 7 wherein said first and second antenna elements transceive radio frequency energy at a first frequency of operation, and said third and fourth antenna elements transceive radio frequency energy at a second frequency of operation.

9. The radio frequency coupling device of claim 7 wherein said first antenna element is configured to transmit radio frequency energy to said second antenna element, and said third antenna element is configured to receive radio frequency energy from said fourth antenna element.

10. In a communication system for providing radio frequency communications between adjacent cars on a multi-car vehicle, each of said cars having coupling arms for connecting said cars to each other, each of said cars further comprising radio frequency transceiving means for transmitting and receiving radio frequency waves representative of data communicated between said cars; the improvement comprising a radio frequency coupling device for transferring radio frequency waves through free space comprising:

a) a first coupler housing mounted on a coupler arm of a first car comprising a first antenna element and a third antenna element, said first antenna element and said third antenna element configured so as to transceive separate channels of radio frequency energy substantially out of phase from each other; and b) a second coupler housing mounted on a coupler arm of a second car comprising a second antenna element and a fourth antenna element, said second coupler housing located in near proximity to said first coupler housing, said second antenna element and said fourth antenna element configured so as to transceive separate channels of radio frequency energy substantially out of phase from each other, said second antenna element located in near proximity to said first antenna element and substantially in phase therewith so as to couple a first channel of radio frequency energy therebetween, and said fourth antenna element located in near proximity to said third antenna element and substantially in phase therewith so as to couple a second channel of radio frequency energy therebetween;

said first coupler housing and said second coupler housing having at least one degree of freedom of movement therebetween.

* * * * *